US007994080B2

(12) United States Patent
Théorêt et al.

(10) Patent No.: US 7,994,080 B2
(45) Date of Patent: Aug. 9, 2011

(54) ELECTRICALLY CONDUCTIVE NON-WOVEN FABRIC

(75) Inventors: Richard Théorêt, Montréal (CA); Olivier Vermeersch, St-Hyacinthe (CA)

(73) Assignee: Soleno Textiles Techniques Inc., Laval, Québec (CA)

( * ) Notice: Subject to any disclaimer, the term of this patent is extended or adjusted under 35 U.S.C. 154(b) by 0 days.

(21) Appl. No.: 12/298,022

(22) PCT Filed: Mar. 22, 2006

(86) PCT No.: PCT/CA2006/000433

§ 371 (c)(1),
(2), (4) Date: Feb. 5, 2009

(87) PCT Pub. No.: WO2006/099736

PCT Pub. Date: Sep. 28, 2006

(65) Prior Publication Data

US 2009/0197495 A1 Aug. 6, 2009

(51) Int. Cl.
*D04H 1/00* (2006.01)
*D04H 13/00* (2006.01)
*D02G 3/00* (2006.01)

(52) U.S. Cl. ..... 442/377; 428/369; 442/402; 442/403; 442/414; 442/415

(58) Field of Classification Search ..... 442/402, 442/403, 414, 415, 377; 428/369
See application file for complete search history.

(56) References Cited

U.S. PATENT DOCUMENTS

| | | | | |
|---|---|---|---|---|
| RE28,470 | E | 7/1975 | Webber | |
| 4,433,840 | A | 2/1984 | Van Auken | |
| 4,722,860 | A | 2/1988 | Doljack et al. | |
| 5,034,267 | A | 7/1991 | McCullough, Jr. | |
| 5,368,913 | A * | 11/1994 | Ortega | 428/198 |
| 5,648,137 | A | 7/1997 | Blackmore et al. | |
| 5,817,974 | A | 10/1998 | Bovenschen et al. | |
| 6,502,289 | B1 * | 1/2003 | Kane et al. | 28/107 |
| 2003/0219646 | A1 | 11/2003 | LeCostaouec | |
| 2004/0198127 | A1 | 10/2004 | Yamamoto et al. | |
| 2004/0209065 | A1 | 10/2004 | Kaplo | |

FOREIGN PATENT DOCUMENTS

| | | | |
|---|---|---|---|
| EP | 1403412 | A1 | 3/2004 |
| WO | WO 92/14877 | * | 9/1992 |

OTHER PUBLICATIONS

Smith, Faye, "Carbon Fibre Based Heating Elements," Materials World, Dec. 2001, pp. 17-18, vol. 9—No. 12.
Rantanen et al., "Smart Clothing for the Arctic Environment," IEEE Computer Society Digital Library, 2000, pp. 15-23.

* cited by examiner

*Primary Examiner* — Norca L Torres-Velazquez
(74) *Attorney, Agent, or Firm* — Muncy, Geissler, Olds & Lowe, PLLC

(57) ABSTRACT

An electrically conductive non-woven fabric (10) for heating applications is described and comprises a three-dimensional network (11) of non-woven synthetic fibers (12) which are non-electrically conductive and electrically conductive strands (13) of synthetic fibers or fine metal wires consolidated therewith. The fabric has an intrinsic resistivity in the range of from about 0.05 to 5 m2/kg.

15 Claims, 2 Drawing Sheets

ELECTRICALLY CONDUCTIVE NON-WOVEN FABRIC

TECHNICAL FIELD

The present invention relates to an electrically conductive non-woven fabric comprising non-woven synthetic fibers and electrically conductive strands of synthetic fibers or fine metal wires consolidated therewith, for numerous heating applications.

BACKGROUND ART

Electrically conductive composite materials are known wherein conductive fibers and non-conductive fibers are secured to a support surface by needle-punching and these may have different applications such as providing shielding against electrical or magnetic fields. Such surface coatings are, for example, described in U.S. Pat. No. 4,433,840.

U.S. Pat. No. 5,648,137 describes a composite material which is impregnated with a heat curable resin comprising a layer of conductive fibers and one or more resin-carrying layers. Such fabrics are therein disclosed to reinforce utility poles. It is also described that this material can be impregnated into molds for curing.

DISCLOSURE OF INVENTION

It is a feature of the present invention to provide a non-woven electrically conductive fabric which is comprised of a three-dimensional network of non-woven synthetic fibers and electrically conductive fibers consolidated therewith to produce a lightweight electrically conductive non-woven fabric.

Another feature of the present invention is to provide an electrically conductive non-woven fabric capable of being incorporated in numerous heating applications and which is inexpensive to fabricate.

According to the above features, from a broad aspect, the present invention provides an electrically conductive non-woven fabric for heating applications which comprises a three-dimensional network of non-woven synthetic fibers which are non-electrically conductive and electrically conductive strands of synthetic fibers or fine metal wires consolidated therewith. The fabric has an intrinsic resistivity in the range of from about 0.05 to 5 $\Omega m^2/kg$.

BRIEF DESCRIPTION OF DRAWINGS

A preferred embodiment of the present invention will now be described with reference to the accompanying drawings in which.

MODES OF CARRYING OUT THE INVENTION

Figure 1:
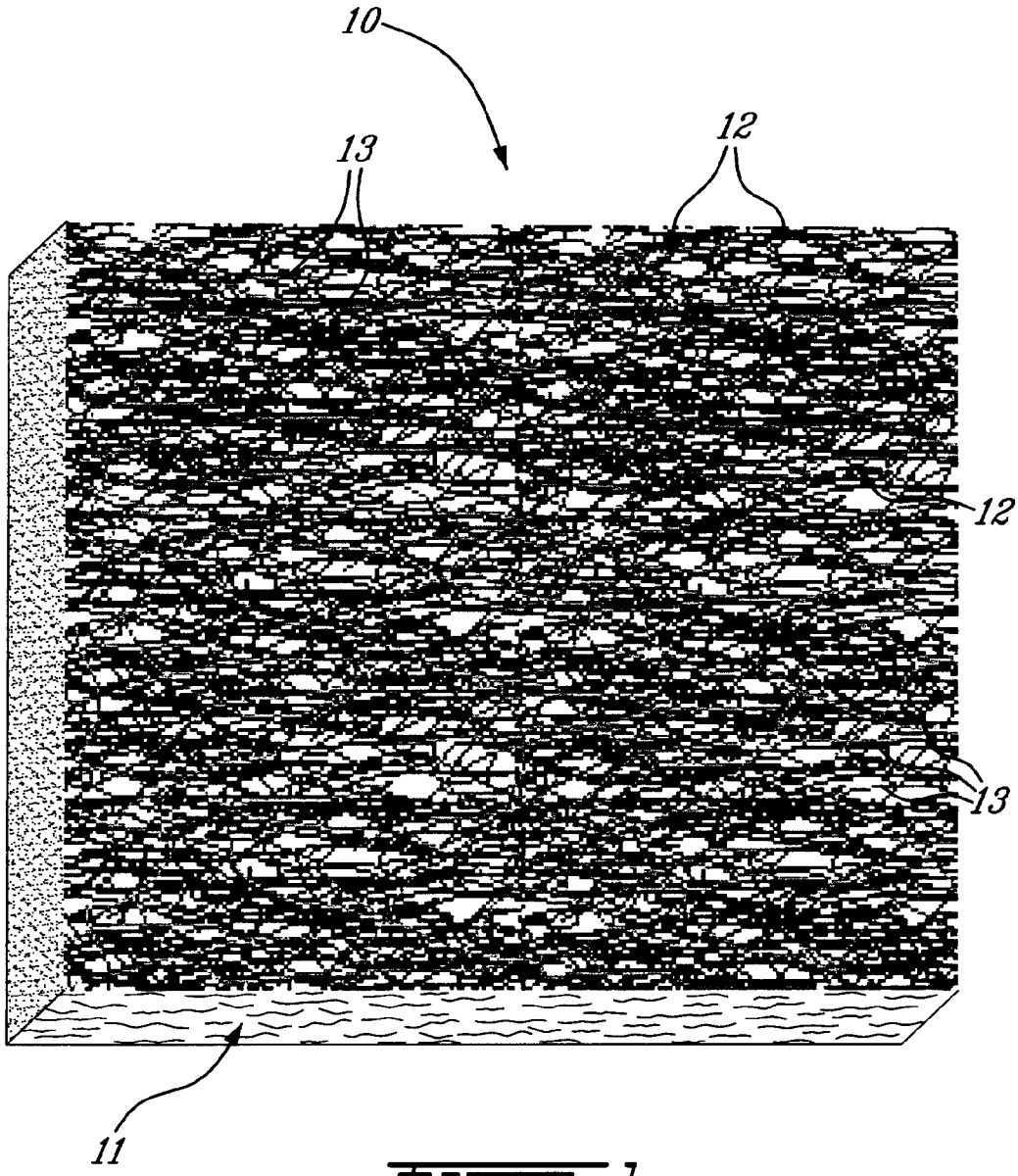
FIG. 1 is a perspective view showing an electrically conductive non-woven fabric constructed in accordance with the present invention.

Referring now to the drawings and more particularly to FIG. 1, there is shown generally at 10 the electrically conductive non-woven fabric of the present invention. It comprises a three-dimensional network 11 of non-woven synthetic fibers

12 and electrically conductive strands 13 consolidated therewith to form a homogenous mass.

The synthetic fibers 12 are polyester fibers but these may also be polypropylene or polyamide fibers. These synthetic fibers are also crimped fibers to provide better consolidation and conductivity due to the intermeshing of the crimped fibers. The consolidation can be effected by needle-punching or other adequate processes. The synthetic fibers also occupy a mass of from about 50 to 98% of the fabric. Preferably, in the present application they occupy a mass of about 90% of the fabric.

The conductive strands 13 occupy a mass of about 5 to 50% of the fabric and in the present application they occupy a mass of about 10%. These conductive strands may be synthetic fibers of PES or other polymer coated with a fine electrically conductive metal. They may also be fine metal wires. These conductive strands have a length of approximately 4 inches in the present application but this can vary between 1 to 6 inches.

The synthetic fibers present a linear density of between 0.5 to 110 denier and preferably about 5 denier. The conductive fibers present a linear density of 0.5 to 110 denier but preferably about 6 denier.

Figure 3:
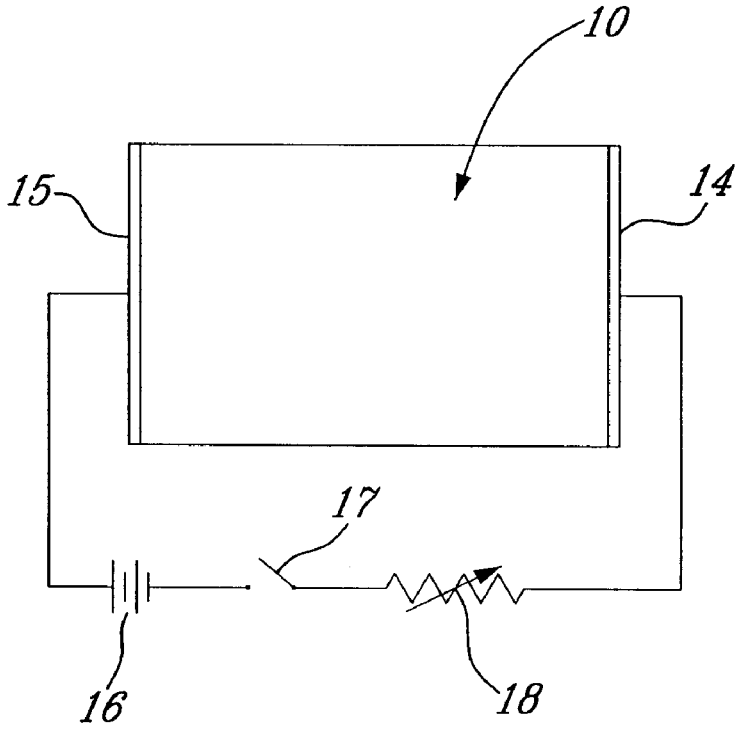
FIG. 3 is a schematic view showing the conductive non-woven fabric connected to a power supply.

As shown in FIG. 3, the electrically conductive non-woven fabric 10 is provided with electrically conductive bands 14 and 15 which constitute electrical terminals. These terminals are connected to a power supply, herein a DC battery 16 whereby to apply a potential thereacross whereby current will flow across the fabric through the conductive fibers to thereby heat the fabric. A switch 17 is provided to switch the voltage on and off and a variable resistance 18 may also be provided to control the potential across the fabric and hence the heat generated thereby. Although FIG. 3 shows a DC supply connected across the fabric, an AC supply could also be provided with a converter (not shown) obvious to a person skilled in the art.

The non-woven electrically conductive fabric of the present invention is characterized by its intrinsic resistivity $\Gamma$ ($\Omega m^2/kg$) and which varies between 0.1 to 5 and in the particular case resides at approximately 0.68.

The heating capacity P(W) of the electrically conductive non-woven fabric 10 depends on the intrinsic resistivity and also of the voltage applied thereacross as well as the mass per unit area MS($kg/m^2$) and the dimension of the non-woven fabric, namely its length L and width l according to the following formula:

$$P(W) = \frac{L(m) \times U^2(V^2) \times MS(\mathrm{kg/m^2})}{\Gamma(\Omega \mathrm{m^2/kg}) \times 1(m)}$$

On the other hand, if we know the required heating capacity or power P of the fabric sheet, the dimensions of the fabric sheet and the available rating of the power supply, we can determine the required mass per unit area MS to achieve the thermal requirement of the fabric in accordance with the following formula:

$$MS(\mathrm{kg/m^2}) = \frac{\Gamma(\Omega \mathrm{m^2/kg}) \times 1(m) \times P(W)}{L(m) \times U^2(V^2)}$$

Figure 2:
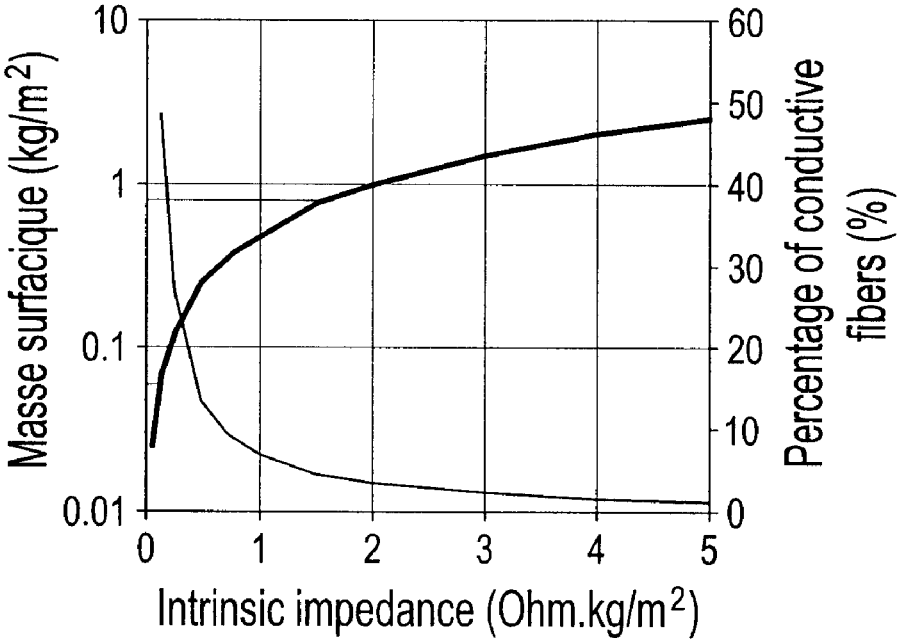
FIG. 2 is a graph illustrating the mass per unit area and the proportion of conducting fibers in the composition constructed in accordance with the present invention.

FIG. 2 illustrates the mass per unit area MS($kg/m^2$) and the proportions of conductive fibers in the consolidated mass for a non-woven heating fabric having an intrinsic resistivity as above-described and varying between 0.05 to 5 for a product generating 72 watts of power and having a length of 40 cm and a width of 40 cm connected to a 12 volt supply. This graph permits one to determine an optimal zone in terms of intrinsic resistivity $\Gamma(\Omega m^2/kg)$ as it is difficult to obtain a surface mass which is less than 0.06 $kg/m^2$ in the case of a non-woven fabric having short fibers consolidated by needle-punching. It is also not feasible to utilize a surface mass which is more than 0.8 $kg/m^2$. The graph also illustrates that it is difficult to assure uniformity of the products when the percentage of the short fibers is inferior to 5%. The product of the present invention is at the center of this optimal zone.

It is pointed out that it is within the present invention to cover any obvious modifications of the preferred embodiment described herein. As pointed out above, the conductive strands may be synthetic fibers, such as PES or other polymers which are coated with a fine conductive coating such as silver, gold, copper, aluminum or steel. These fibers may also be constituted by fine metal wires of silver, gold, copper, aluminum, steel or stainless steel, etc.

There are several applications for the non-woven conductive fabric of the present invention and a few of these are readily conceivable. In industrial applications it is foreseen that such fabric can be utilized under pavement (e.g., asphalt, concrete, concrete pavers, etc. . . . ) or integrated with an underpad for heating floor surfaces (e.g., wooden floors, floating floors, ceramic tile floors, or any other type of floor), walls and ceilings. By such applications, the fabric could ultimately replace traditional interior heating systems by inducing heating by radiation. Moreover, applications requiring surface heating, such as roof heating for snow and ice melting, and greenhouse tables supporting sowing can also benefit from the heat transmission properties of the fabric.

They may also be used for curing concrete or other materials, particularly in cold, climatic conditions. They can also be wrapped around elements to be heated, such as plumbing conduits, inground pipes, etc. Because of the lightweight of the fabric, it is easily manipulated by construction workers to cover very large surfaces to be heated.

Another application of such fabric is in articles of clothing wherein it can be incorporated therein and does not add any substantial weight to the article. Because of its composition, the fabric may be stitched into the fabric as the stitches would not alter the conductive characteristics thereof. Contemplated articles of clothing include non-exclusively gloves, jackets, boots. It is also foreseeable that this material can be used as seat warmers in automobiles or other applications such as ski-lift seats. These are only a few examples of the use of the non-woven fabric constructed in accordance with the present invention but several other uses are foreseeable and intended to be covered by this application and the claims thereof.

The invention claimed is:

1. An electrically conductive non-woven fabric for heating applications comprising a three-dimensional network of non-woven non-electrically conductive synthetic fibers and electrically conductive strands of synthetic fibers or fine metal wires consolidated therewith, with the conductive strands having a length between 1 to 6 inches, the non-electrically conductive synthetic fibers occupying a mass between 50% to 98% of said fabric such that said fabric has an intrinsic resistivity in the range of from about 0.05 to 5 Ωm2/kg.

2. An electrically conductive fabric as claimed in claim 1 wherein said non-electrically conductive synthetic fibers have a linear density of between 0.5 to 15 denier.

3. An electrically conductive fabric as claimed in claim 1 wherein said non-electrically conductive synthetic fibers have a linear density of about 5 denier.

4. An electrically conductive fabric as claimed in claim 1 wherein said conductive strands have a linear density of between 0.5 to 15 denier.

5. An electrically conductive fabric as claimed in claim 1 wherein said conductive strands have a linear density of about 6 denier.

6. An electrically conductive fabric as claimed in claim 5 wherein said conductive strands have a length of approximately 4 inches.

7. An electrically conductive fabric as claimed in claim 2 wherein said non-electrically conductive synthetic fibers are one of polypropylene, polyamide or polyester.

8. An electrically conductive fabric as claimed in claim 2 wherein said non-electrically conductive synthetic fibers are crimped fibers.

9. An electrically conductive fabric as claimed in claim 2 wherein said non-electrically conductive synthetic fibers occupy a mass of about 90% of said fabric.

10. An electrically conductive fabric as claimed in claim 4 wherein said conductive fibers are one of polyester or other polymer coated with a fine electrically conductive metal, or fine metal wires.

11. An electrically conductive fabric as claimed in claim 4 wherein said conductive strands occupy a mass of from about 5% to 50% of said fabric.

12. An electrically conductive fabric as claimed in claim 4 wherein said conductive strands occupy a mass of about 10%.

13. An electrically conductive material as claimed in claim 12 wherein said fabric has an intrinsic resistivity of 0.68 D.m2/kg.

14. An electrically conductive fabric as claimed in claim 1 wherein said conductive fibers and non-woven non-electrically conductive synthetic fibers are consolidated together by needle punching.

15. An electrically conductive fabric as claimed in claim 1 wherein said fabric is provided with electrical terminals at opposed ends thereof to apply an electrical potential there across to heat said fabric.

* * * * *